United States Patent [19]

Thoma

[11] Patent Number: 4,588,480

[45] Date of Patent: May 13, 1986

[54] METHOD OF PRODUCING WEAR-PROTECTION LAYERS ON SURFACES OF STRUCTURAL PARTS OF TITANIUM OR TITANIUM-BASE ALLOYS

[75] Inventor: Martin Thoma, Munich, Fed. Rep. of Germany

[73] Assignee: MTU Motoren-und Turbinen-Union Munchen GmbH, Munich, Fed. Rep. of Germany

[21] Appl. No.: 612,793

[22] Filed: May 22, 1984

[30] Foreign Application Priority Data

Jun. 11, 1983 [DE] Fed. Rep. of Germany ..... 3321231

[51] Int. Cl.[4] ..... C23C 18/36; C25D 5/50

[52] U.S. Cl. ..... 204/37.1; 156/628; 156/656; 156/664; 204/29; 204/32.1; 204/35.1; 427/309; 427/383.9; 427/438

[58] Field of Search ..... 204/37.1, 35.1, 32.1, 204/29; 427/383.9, 309, 438; 156/628, 656, 664

[56] References Cited

U.S. PATENT DOCUMENTS

| | | | |
|---|---|---|---|
| 2,946,728 | 7/1960 | Foisel et al. | 204/37 |
| 3,560,274 | 2/1971 | Ogden | 148/31.5 |
| 3,647,647 | 3/1972 | Winfree | 148/6.2 |
| 4,236,940 | 12/1980 | Manty et al. | 204/32.1 |
| 4,414,039 | 11/1983 | Thoma | 148/6.2 |

OTHER PUBLICATIONS

F. A. Lowenheim, *Electroplating,* McGraw-Hill Book Co., New York, 1978, pp. 389-393.

Patent Abstracts of Japan No. 58-91165, 5/1983.

Surface Hardening Process for Titanium-Abstract of Japanese Patent Publication No. 56-81665, 12/1979.

Chemical Abstract, vol. 80, 1984, p. 163.

Metal Finishing-51st Guidebook Directory-1983, pp. 280, 282.

Nickel & Chromium Plating-Dennis et al., 1972, Newnes-Butterworths, London, pp. 277-278.

*Primary Examiner*—John F. Niebling

*Assistant Examiner*—William T. Leader

*Attorney, Agent, or Firm*—Roberts, Spiecens & Cohen

[57] ABSTRACT

A method of producing a wear protection coating on a surface of a structural part of titanium or a titanium base alloy comprising applying a metallic nickel layer which adheres to the surface of the structural part and thereafter subjecting the thus coated structural part to a heat treatment to form diffusion layers of $Ti_2Ni$ and $TiNi_3$ between the titanium and the nickel. Thereafter, the layer of nickel alone or with the layer of $TiNi_3$ is removed to leave the titanium part covered by a protection layer of the remaining diffusion layer.

17 Claims, No Drawings

METHOD OF PRODUCING WEAR-PROTECTION LAYERS ON SURFACES OF STRUCTURAL PARTS OF TITANIUM OR TITANIUM-BASE ALLOYS

FIELD OF THE INVENTION

The invention relates to a method of producing wear protection layers on surfaces of structural parts of titanium or titanium-base alloys.

PRIOR ART

Due to the relatively poor resistance to wear of titanium materials, it has been known for a long time to provide surface protection layers on the titanium materials. Chemicals and electrochemical methods for the coating of titanium materials are known. Thus, it is known from MTU-Berichte 83/87 published by MTU MOTOREN-UND TURBINEN-UNION MÜNCHEN GMBH, in an article by M. Thoma (the inventor herein) entitled "Titanium Surfacing Techniques" to deposit coating materials from galvanic baths onto the surface of titanium materials. It has been found that by these methods, strongly adherent protective layers can generally be obtained but, in the case of greater mechanical or thermal stressing of structural parts coated in this manner, even greater bond strength of the wear protection layers would be desirable.

From the "12th Annual Airlines Plating Forum," 1976, page 5, in an article written by Jennings, a method is described in which a coating of nickel is applied to a titanium structural part and the bond strength of this nickel layer is increased by diffusion heat treatment at 480° C. Apart from the fact that nickel is not particularly suitable as a wear protection layer, it is found that under certain operating conditions, the bond strength is still not sufficient and that the layer of nickel becomes detached in whole or in part.

SUMMARY OF THE INVENTION

An object of the present invention is to provide a method by which a wear protection layer can be produced on a titanium material which has particularly high resistance to abrasion and erosion and which retains its intimate bond to the titanium material even under extreme operating conditions.

In accordance with the above and other objects of the invention, a metallic layer of nickel is applied in strongly bonded fashion to the surface of a structural part of titanium or titanium based alloy, whereupon the structural part is subjected, in air or vacuum, to a heat treatment such that diffusion layers of $Ti_2Ni$ and $TiNi_3$ are formed between the titanium base material, on the one hand, and the layer of nickel, on the other hand, whereafter the layer of nickel which is still present is removed.

An essential concept of the invention is that the nickel coating is used merely to form the diffusion layers with the titanium base material and is then itself removed so that the problem of the bond strength of the nickel layer is no longer of importance. This constitutes a considerable advantage of the method of the invention over traditional methods of coating since the wear protection layers, namely the intermetallic phases $Ti_2Ni$ and $TiNi_3$ are homogeneously bonded to the titanium base material. The $TiNi_3$ layer, which forms the cover layer after removal of the remaining nickel layer, has an extremely high resistance to wear since it reaches degrees of hardness in the vicinity of 1000 HV. Because of the brittleness connected therewith, a structural part having a cover layer of $TiNi_3$ is suitable, in particular, to the case of static operation.

If structural parts are to be provided with surface protection layers which are subjected to rotating or oscillating stresses then, in accordance with another embodiment of the invention, the $TiNi_3$ layer is also removed in addition to the nickel layer so that the layer of $Ti_2Ni$ remains as the cover layer. The hardness of this layer is still considerable and amounts to about 600 HV; however, it is more ductile than the $TiNi_3$ layer.

Further advantages of the method of the invention reside in the fact that the rate of diffusion of nickel in titanium is exceptionally high and accordingly the heat treatment takes only a relatively short period of time in the case of relatively thin layers. Another advantage of the method of the invention is that the diffusion layers are formed in very uniform manner over the entire surface of the titanium structural part, namely, both with respect to the distribution of the thickness and with respect to the composition. Thus, the method of the invention is suitable for mass production since there is a high degree of reproducibility.

DETAILED DESCRIPTION OF PREFERRED EMBODIMENTS

The invention contemplates the production of a wear protection coating on the surface of a structural part made of titanium or a titanium-base alloy which comprises first applying a metallic nickel layer to the surface of the structural part and thereafter subjecting the thus coated structural part, in air or in vacuum, to a heat treatment to form diffusion layers of $Ti_2Ni$ and $TiNi_3$ between the titanium material and the nickel layer whereafter the nickel layer is removed. As a consequence, the titanium material will now be coated with the diffusion layers of $Ti_2Ni$ and $TiNi_3$.

Under selected circumstances such as where the outer layer of $TiNi_3$ may be too brittle for the usage of the particular part the $TiNi_3$ layer can be removed to leave only the $Ti_2Ni$ layer exposed on the surface of the titanium part.

In order to obtain a desired bonding strength of the metallic nickel layer and the titanium material, the titanium surface is treated by an eroding process such as etching and activation is conventional before the application of the nickel layer.

The etching and activation, can be carried out in accordance with the disclosure in DE OS No. 31 33 189 and corresponding U.S. Pat. No. 4,414,039. Therein is disclosed that the etching is effected in a solution of nitric acid and hydrofluoric acid and the activation is effected in a bath consisting of chromic acid, hydrofluoric acid and hexafluorosilicic acid.

Depending on the thickness desired for the wear protection layers which are formed on the surface of the titanium structural part, the metallic nickel is applied in a layer having a thickness of 5 to 50 μm.

The layer of nickel can be deposited electrolytically or chemically on the titanium structural part. Electrolytic deposition is preferably effected in a galvanic bath with nickel sulphamate. Chemical deposition of the nickel layer is preferably effected by reacting the titanium surface in a bath consisting of a nickel salt, a complexing agent and a chemical reducing agent, such as hypophosphite.

The heat treatment for the production of the diffusion layers is preferably effected at temperatures of 400 to 950° C. with a duration of 30 minutes to 300 hours, the high temperatures being employed for shorter periods of time and vice versa. Temperature and time determine the layer thickness of the diffusion zones which are formed. The sequence of the layers from the outside to the inside is: nickel, $TiNi_3$, $Ti_2Ni$, and titanium or titanium alloy material.

Upon heat treatment of the titanium or titanium alloy material at 600° C. for eight hours, two diffusion layers of $TiNi_3$ and $Ti_2Ni$ are formed, each layer having a thickness of about 4 μm. The hardness of the diffusion layers thus produced differs very substantially from the initial materials of nickel and titanium, as can be seen from the following tabulated hardness values:

Nickel: 140 HV
$TiNi_3$: 1000 HV
$Ti_2Ni$: 600 HV
$TiAl_6V_4$: 240 HV

It is advantageous for the removal of the nickel cover layer or the nickel cover layer plus the $TiNi_3$ layer to be effected chemically by the action of $HNO_3$ or by a nitroaromatic solution (cyanidic) at temperatures between 10° and 60° C. The time for removal of the layers is between 15 minutes and 2 hours, depending on the thickness of the residual layer of nickel, the concentration of the removal bath, and the temperature of the bath.

Although the invention has been described in relation to preferred embodiments thereof, it will become apparent to those skilled in the art that numerous modifications and variations can be made within the scope and spirit of the invention as defined in the attached claims.

What is claimed is:

1. A method of producing a wear-protection coating on a surface of a structural part of titanium or a titanium-base alloy comprising applying a metallic nickel layer which adheres to the surface of the structural part, and subjecting the thus coated structural part to a heat treatment to form diffusion layers of $Ti_2Ni$ and $TiNi_3$ between the titanium material, on the one hand, and the layer of nickel, on the other hand, and thereafter chemically removing all of the layer of nickel still present to expose one of the diffusion layers.

2. A method as claimed in claim 1, comprising removing the layer of $TiNi_3$ in addition to the layer of nickel.

3. A method as claimed in claim 1, comprising eroding the surface of the structural part containing titanium material before applying the nickel layer to enhance the strength of bond between the metallic nickel layer and the titanium material.

4. A method as claimed in claim 3 wherein the eroding of the surface comprises etching and activation of said surface.

5. A method as claimed in claim 4, wherein said etching is effected in a solution of nitric acid and hydrofluoric acid and the activation is effected in a bath consisting of chromic acid, hydrofluoric acid and hexafluorosilicic acid.

6. A method as claimed in claim 1 wherein the metallic nickel is applied in a layer having a thickness of 5 to 50 μm.

7. A method as claimed in claim 6, wherein the layer of nickel is deposited electrolytically.

8. A method as claimed in claim 7 wherein the electrolytic deposit of nickel is effected in a galvanic bath containing nickel sulfamate.

9. A method as claimed in claim 6, wherein the layer of nickel is deposited chemically.

10. A method as claimed in claim 9 wherein the chemical deposit of nickel is effected by reaction of the titanium surface with a bath consisting of Ni salt, a complexing agent, and a chemical reducing agent.

11. A method as claimed in claim 10 wherein the chemical reducing agent is hypophosphite.

12. A method as claimed in claim 1 wherein the heat treatment is effected at a temperature of 400° to 950° C. for a period of 30 minutes to 300 hours.

13. A method as claimed in claim 1, wherein the chemical removal of the layer of nickel is effected by the action of $HNO_3$ or a cyanidic nitroaromatic solution at temperatures between 10° and 60° C.

14. A method as claimed in claim 2 wherein the chemical removal of the $TiNi_3$ layer is effected by the action of $HNO_3$ or a cyanidic nitroaromatic solution at temperatures between 10° and 60° C.

15. A method as claimed in claim 1 wherein the heat treatment is effected at 600° C.

16. A method as claimed in claim 15 wherein the heat treatment is effected for 8 hours.

17. A method as claimed in claim 15 wherein the layers of $Ti_2Ni$ and $TiNi_3$ are of equal thickness, the layer of $TiNi_3$ being of greater hardness than the layer of $Ti_2Ni$.

* * * * *